US010655485B2

(12) United States Patent
Zemitis et al.

(10) Patent No.: US 10,655,485 B2
(45) Date of Patent: May 19, 2020

(54) STRESS-RELIEVING POCKET IN TURBINE NOZZLE WITH AIRFOIL RIB

(71) Applicant: General Electric Company, Schenectady, NY (US)

(72) Inventors: William Scott Zemitis, Greenville, SC (US); Dwight Davidson, Greenville, SC (US); Brad Van Tassel, Greenville, SC (US)

(73) Assignee: General Electric Company, Schenectady, NY (US)

( * ) Notice: Subject to any disclaimer, the term of this patent is extended or adjusted under 35 U.S.C. 154(b) by 170 days.

(21) Appl. No.: 15/668,371

(22) Filed: Aug. 3, 2017

(65) Prior Publication Data

US 2019/0040751 A1 Feb. 7, 2019

(51) Int. Cl.
*F01D 9/04* (2006.01)

(52) U.S. Cl.
CPC ..... *F01D 9/041* (2013.01); *F05D 2220/32* (2013.01); *F05D 2230/10* (2013.01); *F05D 2240/126* (2013.01); *F05D 2240/128* (2013.01); *F05D 2240/80* (2013.01); *F05D 2250/294* (2013.01); *F05D 2260/30* (2013.01)

(58) Field of Classification Search
CPC ..... F05D 2220/32; F05D 2230/10; F05D 2240/126; F05D 2260/30; F05D 2240/12; F05D 2260/94; F05D 2260/941; F05D 2240/80; F05D 2240/11; F01D 9/042; F01D 9/044; F01D 5/143; F01D 9/041
USPC ..... 415/210.1
See application file for complete search history.

(56) References Cited

U.S. PATENT DOCUMENTS

| | | | | |
|---|---|---|---|---|
| 2,724,544 | A * | 11/1955 | Hardigg | F01D 9/04 415/194 |
| 4,639,189 | A * | 1/1987 | Rosman | F01D 9/041 415/115 |
| 5,797,725 | A * | 8/1998 | Rhodes | B23P 6/005 415/209.2 |
| 6,517,313 | B2 * | 2/2003 | Rogers | F01D 9/04 415/137 |
| 8,133,015 | B2 | 3/2012 | Briggs et al. | |
| 8,205,101 | B2 | 6/2012 | Schilling et al. | |
| 2004/0170499 | A1 * | 9/2004 | Powis | F01D 5/189 416/97 R |
| 2010/0172748 | A1 | 7/2010 | Snook et al. | |
| 2018/0187551 | A1 * | 7/2018 | Buchholz | F01D 9/041 |

FOREIGN PATENT DOCUMENTS

| | | | | |
|---|---|---|---|---|
| EP | 3112589 | A1 * | 1/2017 | F01D 9/041 |

* cited by examiner

*Primary Examiner* — Moshe Wilensky
*Assistant Examiner* — Andrew Thanh Bui
(74) *Attorney, Agent, or Firm* — Nixon & Vanderhye P.C.

(57) ABSTRACT

A turbine nozzle segment includes a radially-inner endwall, a radially-outer endwall, a pair of airfoil-shaped vanes extending between the radially-inner endwall and the radially-outer endwall, and respective reinforcing ribs extending between the pressure and suction sidewalls of the vanes. The back face of the radially-inner endwall and/or the back face of the radially-outer endwall has a pocket formed therein in an area between the pressure sidewall of the first vane and the suction sidewall of the second vane to enhance stiffness distribution between the second vane and the radially-inner endwall and/or radially-outer endwall.

20 Claims, 7 Drawing Sheets

STRESS-RELIEVING POCKET IN TURBINE NOZZLE WITH AIRFOIL RIB

TECHNICAL FIELD

This invention relates generally to gas turbine engines, and more specifically, to methods and apparatuses for reducing nozzle stress in a gas turbine engine.

BACKGROUND

A gas turbine engine generally includes in serial flow communication a compressor, a combustor, and a turbine. The compressor provides compressed airflow to the combustor wherein the airflow is mixed with fuel and ignited, which creates combustion gases. The combustion gases flow to the turbine which extracts energy therefrom.

The turbine includes one or more stages, with each stage having an annular turbine nozzle set for channeling the combustion gases to a plurality of rotor blades. The turbine nozzle set includes a plurality of circumferentially spaced nozzles fixedly joined at their roots and tips to a radially inner sidewall and a radially outer sidewall, respectively. Each individual nozzle has an airfoil cross-section and includes a leading edge, a trailing edge, and pressure and suction sides extending therebetween. Exposure to changing temperatures, in combination with the load on each nozzle can lead to undesirable stress which may reduce a useful life of the nozzle. Typically, the leading edge and trailing edge are the most common areas where cracks appear.

BRIEF SUMMARY

One aspect of the disclosed technology relates to a turbine nozzle segment having a radially-inner endwall, a radially-outer endwall, a pair of airfoil-shaped vanes extending between the radially-inner endwall and the radially-outer endwall, and respective reinforcing ribs extending between pressure and suction sidewalls of the vanes, wherein a back face of the radially-inner endwall and/or a back face of the radially-outer endwall has a pocket formed therein in an area between the pressure sidewall of the first vane and the suction sidewall of the second vane to enhance stiffness distribution between the second vane and the radially-outer endwall.

One exemplary but nonlimiting aspect of the disclosed technology relates to a nozzle segment for a gas turbine comprising a radially-inner endwall, the radially-inner endwall having a flowpath face exposed to combustion gases of the gas turbine and a back face opposed to the flowpath face; a radially-outer endwall, the radially-outer endwall having a flowpath face exposed to the combustion gases and a back face opposed to the flowpath face of the radially-outer endwall; a first airfoil-shaped vane extending between the radially-inner endwall and the radially-outer endwall, the first vane having a leading edge facing in an upstream direction, a trailing edge facing in a downstream direction and opposing pressure and suction sidewalls extending in span between the radially-inner endwall and the radially-outer endwall and in chord between the leading edge and the trailing edge; and a second airfoil-shaped vane extending between the radially-inner endwall and the radially-outer endwall, the second vane having a leading edge facing in the upstream direction, a trailing edge facing in the downstream direction and opposing pressure and suction sidewalls extending in span between the radially-inner endwall and the radially-outer endwall and in chord between the leading edge and the trailing edge, wherein the second vane has a reinforcing rib extending between the pressure sidewall and the suction sidewall, wherein the back face of the radially-inner endwall and/or the back face of the radially-outer endwall has a pocket formed therein in an area between the pressure sidewall of the first vane and the suction sidewall of the second vane to enhance stiffness distribution between the second vane and the radially-inner endwall and/or radially-outer endwall, wherein each said pocket comprises a plurality of recesses including first and second recesses, the second recess extending directly adjacent the reinforcing rib, and wherein a thickness of the radially-inner endwall and/or a thickness of the radially-outer endwall in the respective second recess is less than a thickness of the radially-inner endwall and/or the thickness of the radially-outer endwall in the respective first recess.

One exemplary but nonlimiting aspect of the disclosed technology relates to a method of enhancing stiffness distribution in a nozzle segment of a gas turbine, the method, comprising 1) providing a nozzle segment comprising: a radially-inner endwall, the radially-inner endwall having a flowpath face exposed to combustion gases of the gas turbine and a back face opposed to the flowpath face; a radially-outer endwall, the radially-outer endwall having a flowpath face exposed to the combustion gases and a back face opposed to the flowpath face of the radially-outer endwall; a first airfoil-shaped vane extending between the radially-inner endwall and the radially-outer endwall, the first vane having a leading edge facing in an upstream direction, a trailing edge facing in a downstream direction and opposing pressure and suction sidewalls extending in span between the radially-inner endwall and the radially-outer endwall and in chord between the leading edge and the trailing edge; and a second airfoil-shaped vane extending between the radially-inner endwall and the radially-outer endwall, the second vane having a leading edge facing in the upstream direction, a trailing edge facing in the downstream direction and opposing pressure and suction sidewalls extending in span between the radially-inner endwall and the radially-outer endwall and in chord between the leading edge and the trailing edge, wherein the second vane has a reinforcing rib extending between the pressure sidewall and the suction sidewall, and 2) forming a pocket in the back face of the radially-inner endwall and/or the back face of the radially-outer endwall in an area between the pressure sidewall of the first vane and the suction sidewall of the second vane to enhance stiffness distribution between the second vane and the radially-inner endwall and/or radially-outer endwall, wherein each said pocket comprises a plurality of recesses including first and second recesses, the second recess extending directly adjacent the reinforcing rib, and wherein a thickness of the radially-inner endwall and/or a thickness of the radially-outer endwall in the respective second recess is less than a thickness of the radially-inner endwall and/or the thickness of the radially-outer endwall in the respective first recess.

Other aspects, features, and advantages of this technology will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various examples of this technology. In such drawings.

DETAILED DESCRIPTION OF THE ILLUSTRATED EMBODIMENTS

Figure 1:
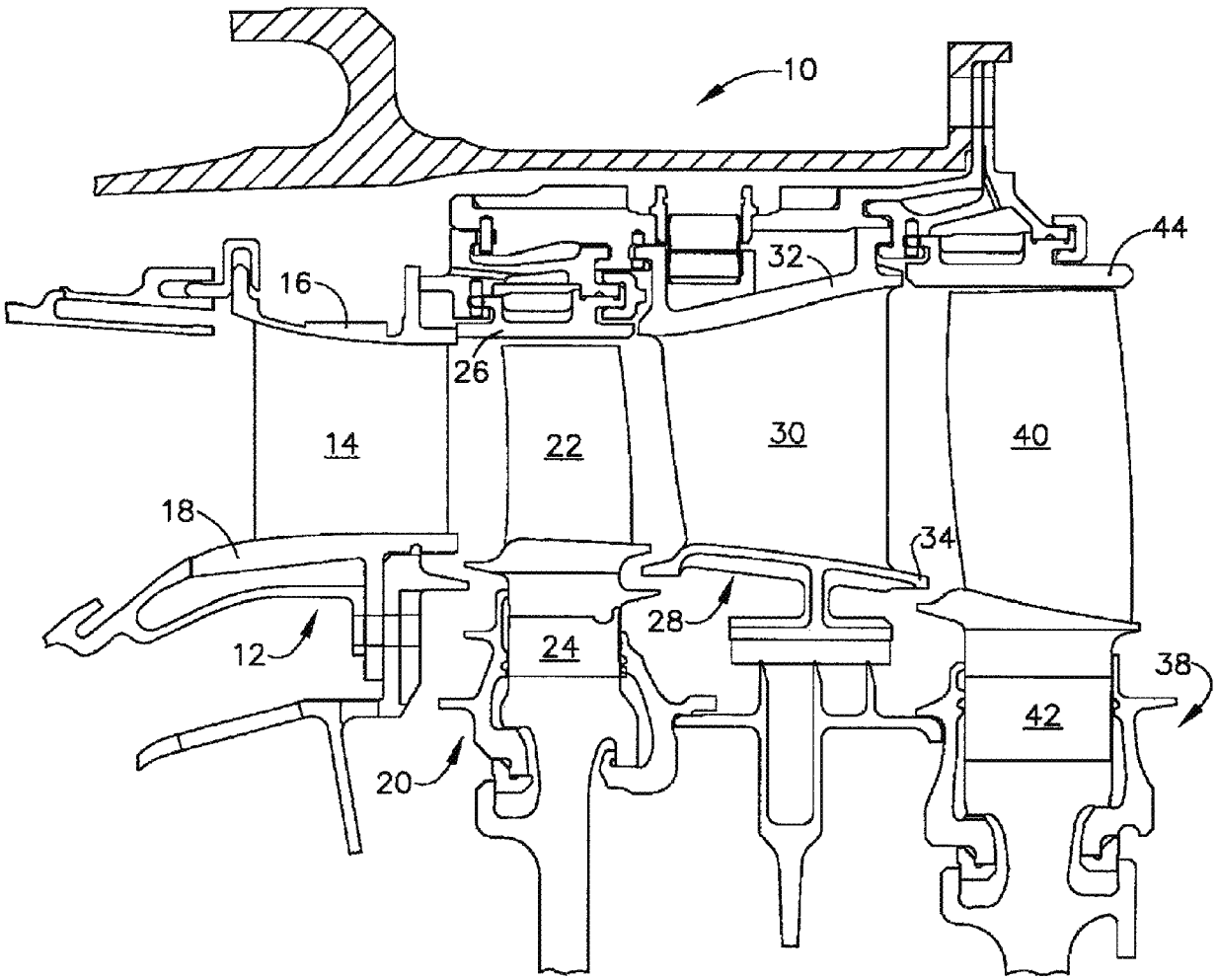
FIG. 1 is a cross-sectional view of a turbine section of a gas turbine engine in accordance with an example of the disclosed technology.

Referring to the drawings wherein identical reference numerals denote the same elements throughout the various views, FIG. 1 depicts a portion of a turbine 10, which is part of a gas turbine engine of a known type. The function of the turbine 10 is to extract energy from high-temperature, pressurized combustion gases from an upstream combustor (not shown) and to convert the energy to mechanical work, in a known manner. The turbine 10 drives an upstream compressor (not shown) through a shaft so as to supply pressurized air to a combustor.

The turbine 10 includes a first stage nozzle 12 which comprises a plurality of circumferentially spaced airfoil-shaped hollow first stage vanes 14 that are supported between an arcuate, segmented first stage outer band 16 and an arcuate, segmented first stage inner band 18. The first stage vanes 14, first stage outer band 16 and first stage inner band 18 are arranged into a plurality of circumferentially adjoining nozzle segments that collectively form a complete 360° assembly. The first stage outer and inner bands 16 and 18 define the outer and inner radial flowpath boundaries, respectively, for the hot gas stream flowing through the first stage nozzle 12. The first stage vanes 14 are configured so as to optimally direct the combustion gases to a first stage rotor wheel 20.

The first stage rotor 20 wheel includes an array of airfoil-shaped first stage turbine blades 22 extending outwardly from a first stage disk 24 that rotates about the centerline axis of the engine. A segmented, arcuate first stage shroud 26 is arranged so as to closely surround the first stage turbine blades 22 and thereby define the outer radial flowpath boundary for the hot gas stream flowing through the first stage rotor wheel 20.

A second stage nozzle 28 is positioned downstream of the first stage rotor wheel 20, and comprises a plurality of circumferentially spaced airfoil-shaped hollow second stage vanes 30 that are supported between an arcuate, segmented second stage outer band 32 and an arcuate, segmented second stage inner band 34. The second stage vanes 30, second stage outer band 32 and second stage inner band 34 are arranged into a plurality of circumferentially adjoining nozzle segments that collectively form a complete 360° assembly. The second stage outer and inner bands 32 and 34 define the outer and inner radial flowpath boundaries, respectively, for the hot gas stream flowing through the second stage turbine nozzle 34. The second stage vanes 30 are configured so as to optimally direct the combustion gases to a second stage rotor wheel 38.

The second stage rotor wheel 38 includes a radial array of airfoil-shaped second stage turbine blades 40 extending radially outwardly from a second stage disk 42 that rotates about the centerline axis of the engine. A segmented arcuate second stage shroud 44 is arranged so as to closely surround the second stage turbine blades 40 and thereby define the outer radial flowpath boundary for the hot gas stream flowing through the second stage rotor wheel 38.

Figure 2:
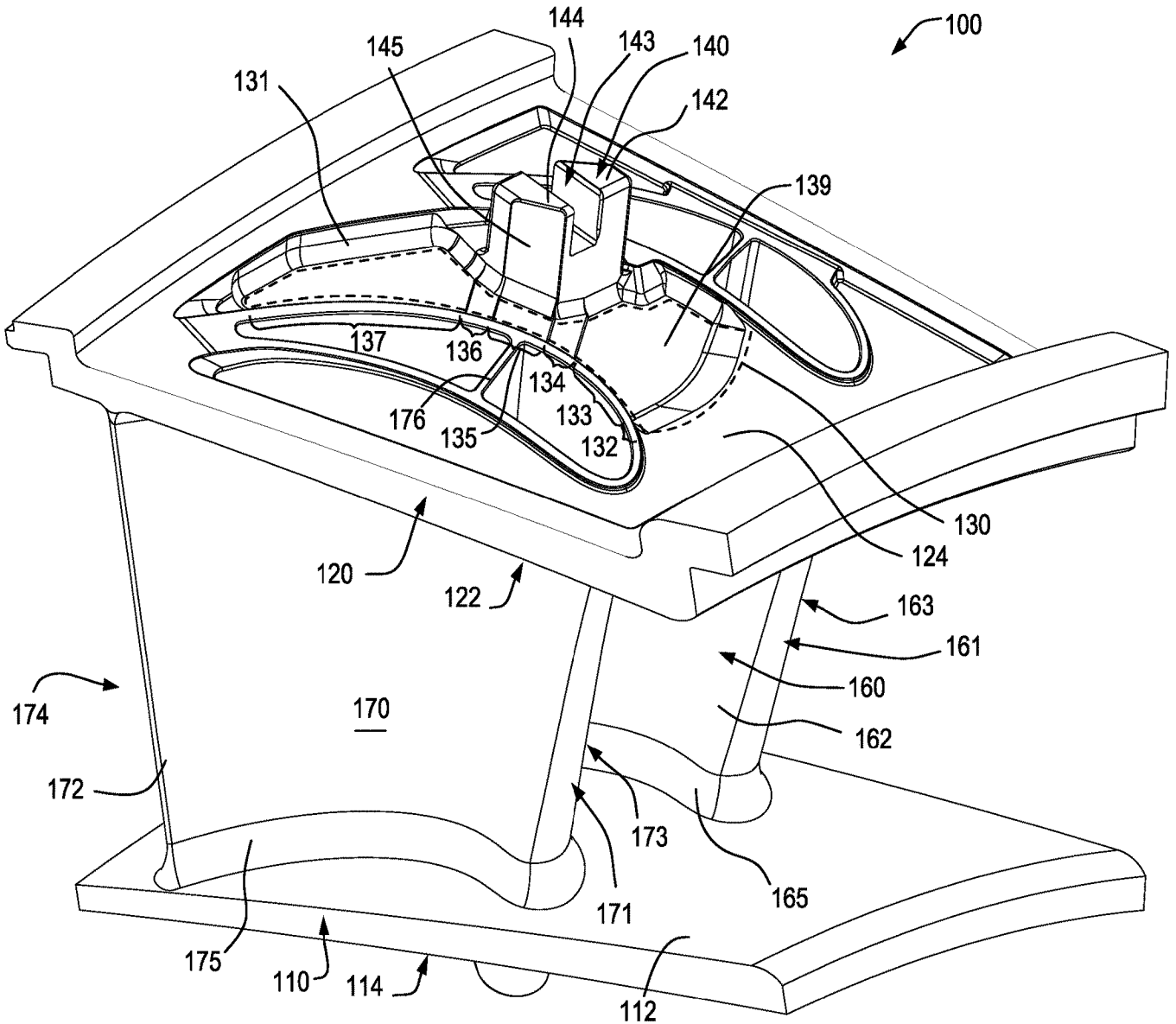
FIG. 2 is a perspective view of a turbine nozzle segment in accordance with an example of the disclosed technology.
Figure 3:
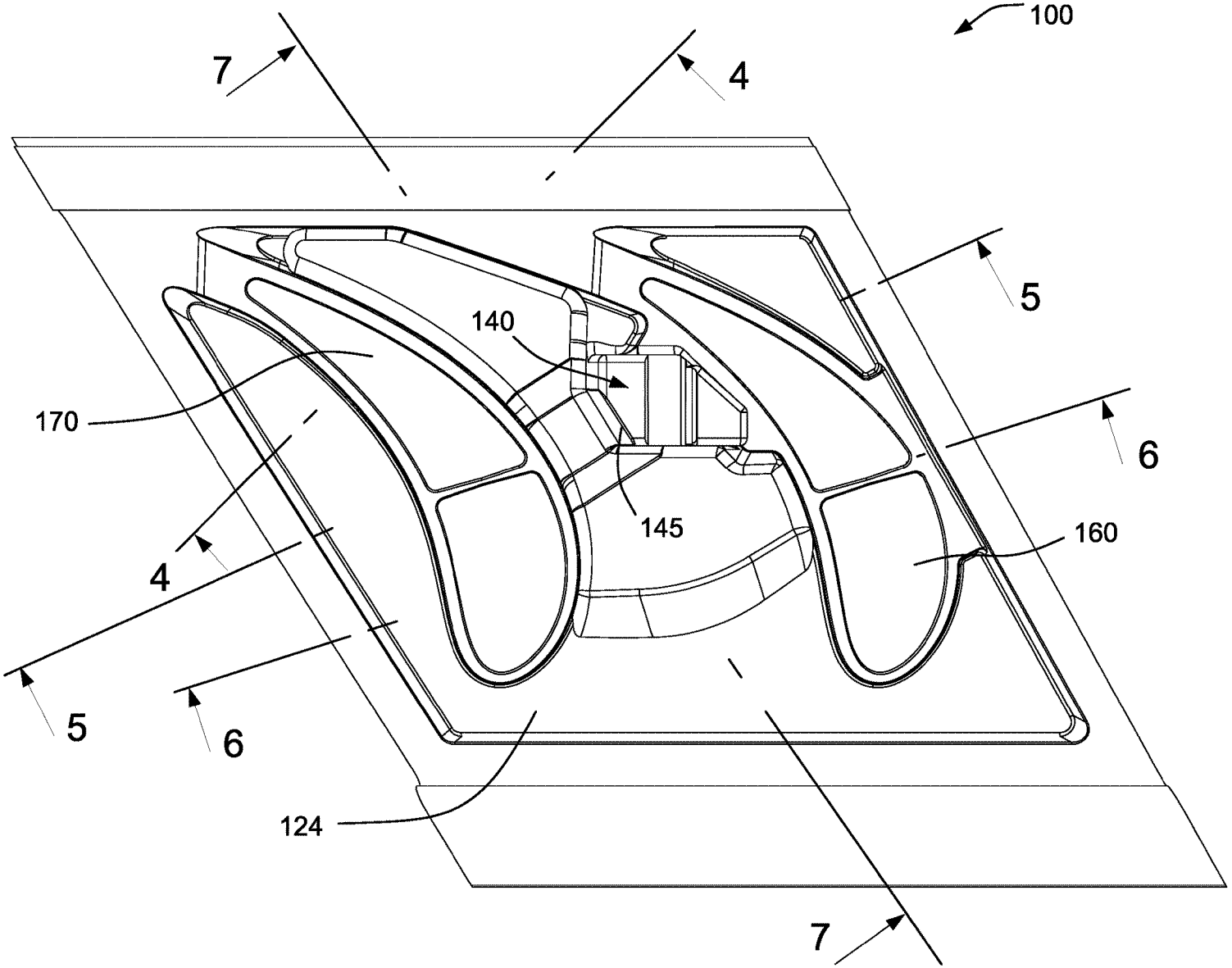
FIG. 3 is a top view of the turbine nozzle segment of FIG. 2.

FIGS. 2 and 3 illustrate one of the several nozzle segments 100 that make up the second stage nozzle 28. Nozzle segment 100 is a doublet nozzle segment (or nozzle doublet) which includes a radially-inner endwall 110 and a radially-outer endwall 120 respectively forming part of the second stage inner band 34 and second stage outer band 32. The nozzle doublet has two airfoil-shaped vanes extending between the inner endwall and the outer endwall and essentially forms one arcuate segment of a plurality of such nozzle doublet segments secured within an annular diaphragm. In another example, the nozzle segment could be a nozzle triplet having three airfoil-shaped vanes or a nozzle quadruplet having four airfoil-shaped vanes. The nozzle segments may be supported in a cantilever configuration, as those skilled in the art will understand.

The radially-inner endwall 110 has a flowpath face 112 that is exposed to the stream of combustion gases and a back face 114 opposed to the flowpath face 112. The radially-outer endwall 120 has a flowpath face 122 that is exposed to the stream of combustion gases and a back face 124 (cold side of endwall 120) opposed to the flowpath face 124.

In this exemplary embodiment, a first vane or airfoil 160 and a second vane or airfoil 170 extend radially (in span) between the flowpath face 112 of the radially-inner endwall 110 and the flowpath face 122 of the radially-outer endwall 120, as shown in FIG. 2. Each vane 160, 170 has a root coupled to the radially-inner endwall 110 and a tip coupled to the radially-outer endwall 120. The vanes 160, 170 have respective leading edges 161, 171 and respective trailing edges 174 (the trailing edge of the first vane 160 is not shown).

Still referring to FIG. 2, the first vane 160 has pressure and suction sidewalls 162, 163 extending in chord between the leading edge 161 and the trailing edge of the first vane. Similarly, the second vane 170 has pressure and suction sidewalls 172, 173 extending in chord between the leading edge 171 and the trailing edge 174 of the second vane.

An anti-rotation lug 140 protrudes radially outward from the back face 124 of the radially-outer endwall 120, as shown in FIG. 2. The anti-rotation lug 140 includes a first portion 142, a second portion 144 and a slot 143 separating the first portion and the second portion, as those skilled in the art understand. The first portion 142 is relatively proximal the pressure sidewall 161 of the first vane 160 whereas the second portion 144 is relatively proximal the suction sidewall 173 of the second vane 170. The second portion 144 has an angled surface 145 that directly faces toward the suction sidewall 173. In plan view, the second portion 144 extends in a tapered manner along the angled surface 145, as best shown in FIG. 3.

A reinforcing rib 176 extends between the pressure sidewall 172 and the suction sidewall 173 of the second vane 170 splitting the hollow cavity of the vane into forward and aft cavities. The reinforcing rib 176 provides significant stiffness to the second vane 170 and the nozzle segment 100 (e.g., the radially-outer endwall 120) in the vicinity of the second vane. The first vane 160 also includes a similar reinforcing rib.

The radially-outer endwall 120 has a thickness that is greater than a thickness of the suction sidewall 173 of the second vane 170. Thus, in conventional nozzle segments, this arrangement results in a non-uniform stiffness distribution that concentrates peak stress on the suction sidewall 173 near the connection with the radially-outer endwall 120. Like the radially-outer endwall 120, the radially-inner endwall 110 may also have a thickness that is greater than a thickness of the suction sidewall 173, which also may result in non-uniform stiffness distribution.

In accordance with an example of the disclosed technology, a pocket 130 is formed in the back face 124 of the radially-outer endwall 120 to reduce the thickness of the endwall in an area immediately adjacent the suction sidewall 173, as shown in FIG. 2. The pocket 130 reduces peak stress in the second vane 170 (e.g., in the suction sidewall 173) and the adjacent portions of the radially-outer endwall 120 by creating a more desirable stiffness distribution that better distributes loads over a wider region.

It is also noted that a pocket may be formed in the back face 114 of the radially-inner endwall 110 to reduce the thickness of the endwall in an area immediately adjacent the suction sidewall 173 to reduce peak stress in the second vane 170 and the adjacent portions of the radially-inner endwall 110.

Those skilled in the art will understand that a pocket may be formed in either the radially-inner endwall 110 or the radially-outer endwall 120, or alternatively, in both the radially-inner endwall 110 and the radially-outer endwall 120. The pockets in the radially-inner endwall 110 and the radially-outer endwall 120 may have the same structure. Only the pocket 130 in the radially-outer endwall 120 will be described in detail.

The pocket is particularly effective on nozzle segments which are supported in a cantilevered configuration since the endwalls tend to be much thicker than the airfoils, which causes the stress to concentrate in the airfoil.

It is also noted that the angled surface 145 of the anti-rotation lug 140 represents a section of the second portion 144 of the lug that has been removed. The removal of a portion of the anti-rotation lug 140 adjacent the suction sidewall 173 also helps to create a more desirable stiffness distribution.

The nozzle segment 100 may be machined to remove material from the radially-outer endwall 120 and the anti-rotation lug to form the pocket 130 and the reduced-size anti-rotation lug 140. This process may be performed on nozzle segments 100 in the field in order to prevent early failure of these devices. Suitable techniques include milling and electron discharge machining (EDM), for example. Alternatively, the nozzle segments 100 may be cast with the pocket 130 and reduced-size anti-rotation lug, machined after casting, or a formed by a combination of such techniques.

A depth of the pocket 130 may vary across the radially-outer endwall 120 in order to optimize stiffness distribution and/or machining/fabrication. The depth may be measured by the distance between the back face 124 of the radially-outer endwall 120 and a bottom surface 139 of the pocket 130.

The pocket 130 is disposed between the suction sidewall 173 of the second vane 170 and the pressure sidewall 162 of the first vane 160, as shown in FIG. 2. An upstream edge of the pocket 130 may be disposed downstream of the leading edges 161, 171 of the first and second vanes 160, 170. Additionally, a downstream edge of the pocket 130 may be upstream of the trailing edges of the first and second vanes. In an example where the nozzle segment is a nozzle triplet, two pockets may be formed, respectively, between the first and second vanes and between the second and third vanes. Similarly, for a nozzle quadruplet, three pockets may be formed, respectively, between the first and second vanes, between the second and third vanes, and between the third and fourth vanes.

Referring to FIG. 2, the pocket 130 may include a plurality of recesses (e.g., first, second and third recesses 133, 135, 137) disposed alternately with (or separated respectively by) a plurality of transitions (e.g., first, second and third ramps 132, 134, 136). Alternatively, the transitions could include other arrangements, for example, one or more steps, a rounded fillet, etc. In an example, within each recess, the depth may vary (e.g., to resemble rolling hills). A fillet 131 is formed around the pocket 130, as shown in FIG. 2.

The first recess 133 is disposed downstream of the leading edges 161,171 of the first and second vanes 160, 170. The second recess 135 is disposed downstream of the first recess 133 and directly adjacent (and between) the reinforcing rib 176 and the second portion 144 of the anti-rotation lug. The third recess 137 is disposed downstream of the second recess 135 and downstream of the anti-rotation lug 140.

The depth of the second recess 135 is less than the depth of the first and third recesses 133, 137. As mentioned above, the reinforcing rib 176 adds stiffness to the second vane 170. Thus, a relatively thicker portion of the radially-outer endwall 120 is provided in the second recess 135 (as compared to the first and third recesses 133, 137) in order to counterbalance the reinforcing rib 176.

The ramp 132 may be disposed at a most upstream portion of the pocket 130 and include an inclined portion of the bottom surface 139 which transitions from the back face 124 to the first recess 133. The second ramp 134 is disposed between the first recess 133 and the second recess 135 as an inclined portion of the bottom surface 139 which transitions from the first recess 133 to the second recess 135. Similarly, the third ramp 136 is disposed between the second recess 135 and the third recess 137 as an inclined portion of the bottom surface which transitions from the second recess 135 to the third recess 137.

Figure 7:
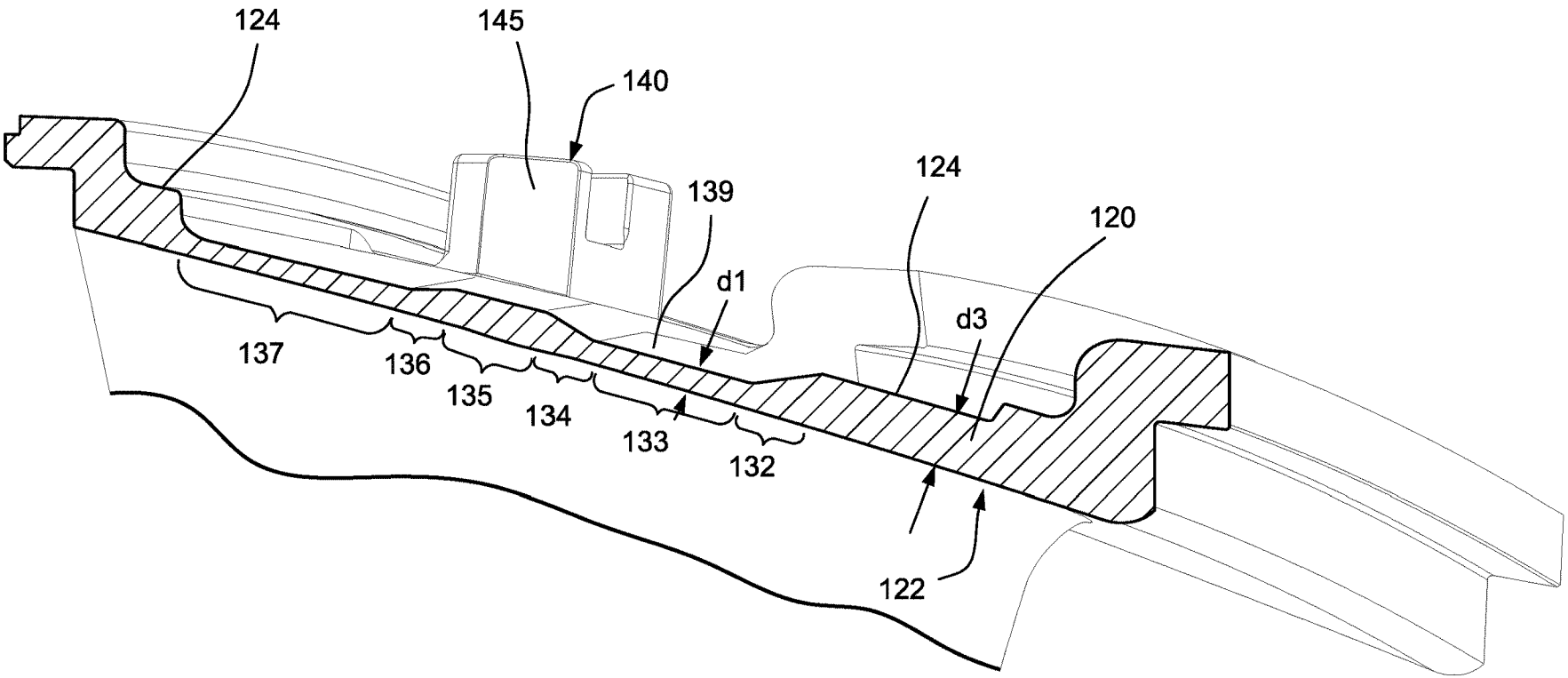
FIG. 7 is a cross-sectional view of along the line 7-7 in FIG. 3.

Turning to FIG. 7, it can be seen that the thickness d1 of the radially-outer endwall 120 in all areas of the pocket 130 is smaller than the thickness d3 of the radially-outer endwall outside of the pocket. In an example, the thickness d3 of the radially-outer endwall 120 outside the pocket may be in the range of 0.4 to 0.8 inches (or 0.5 to 0.75 inches, or 0.5 to 0.7 inches, or 0.55 to 0.65 inches). The thickness d3 may also vary across the endwall. In an example, d3 may be 0.6 inches.

Figure 4:
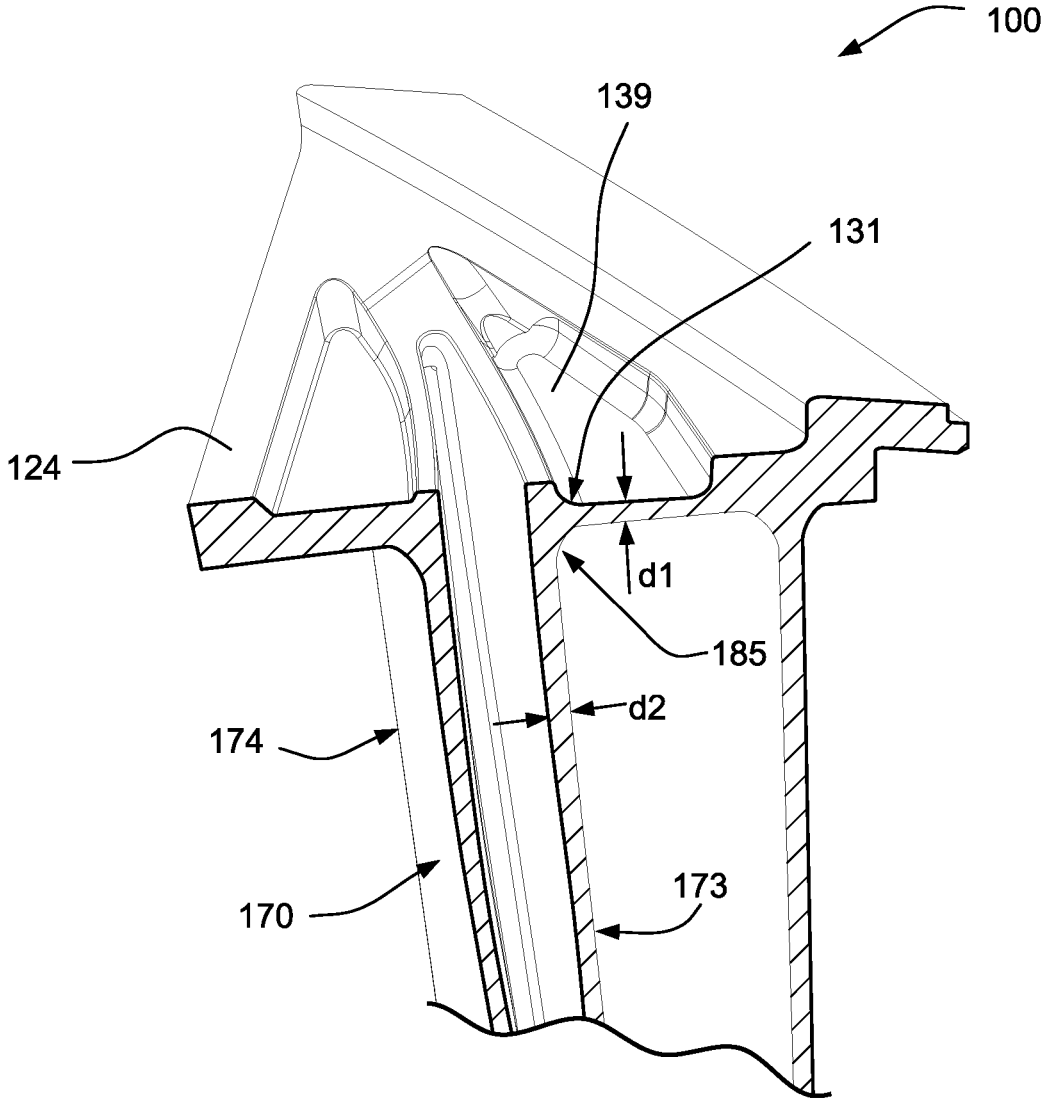
FIG. 4 is a cross-sectional view of along the line 4-4 in FIG. 3.
Figure 5:
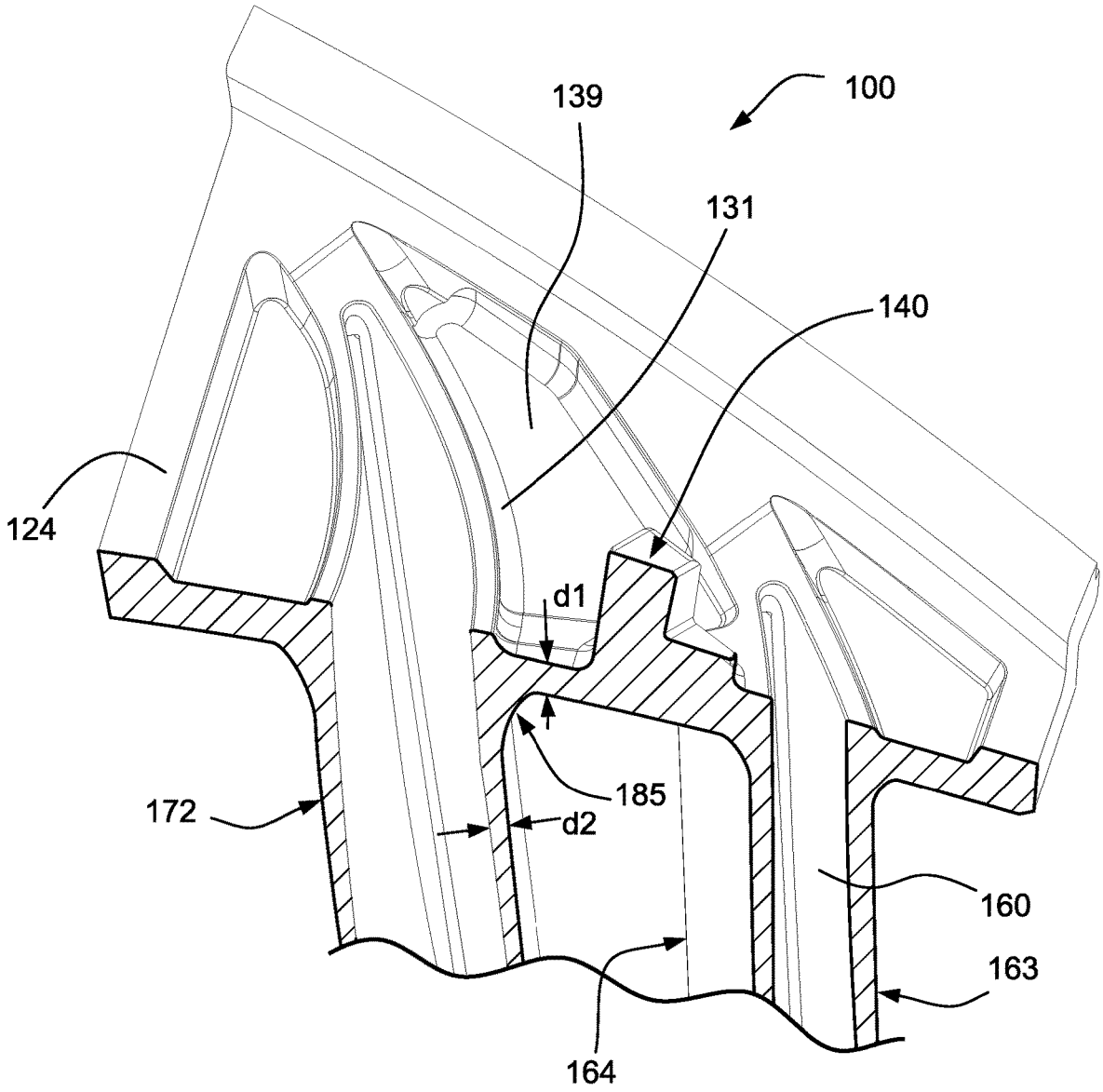
FIG. 5 is a cross-sectional view of along the line 5-5 in FIG. 3.
Figure 6:
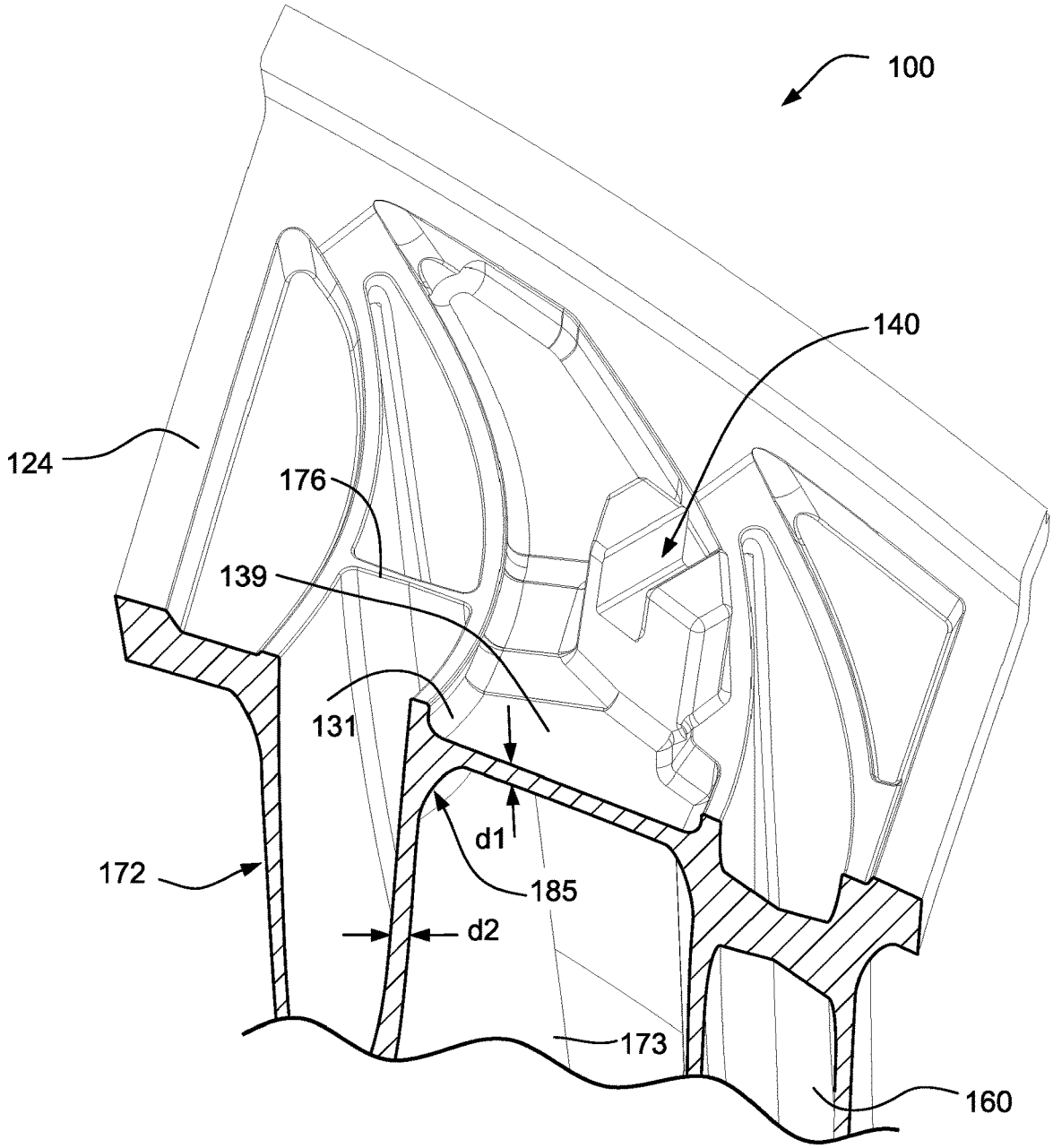
FIG. 6 is a cross-sectional view of along the line 6-6 in FIG. 3.

The reduced thickness of the radially-outer endwall 120 in the pocket 130 brings the thickness of the radially-outer endwall closer to the thickness d2 of the suction sidewall 173 of the second vane 170, as shown in FIGS. 4-6. This creates a more uniform stiffness distribution across the radially-outer endwall 120 and the suction sidewall 173. The hot side of the nozzle segment 100 may include a fillet 185 at the connection between the radially-outer endwall 120 and the suction sidewall 173.

FIG. 4 is a cross-sectional view of the nozzle segment 100 in FIG. 2 along the line 4-4 which extends through the third recess 137. FIG. 5 is a cross-sectional view of the nozzle segment 100 in FIG. 2 along the line 5-5 which extends through the second recess 135. FIG. 6 is a cross-sectional view of the nozzle segment 100 in FIG. 2 along the line 6-6 which extends through the first recess 133.

In an example, the thickness d1 of the radially-outer endwall in the first, second and third recesses 133, 135, 137 may be in the range of 0.3 to 3.0 (or 0.4 to 2.5, or 0.5 to 2.3, or 0.7 to 1.9, or 0.8 to 1.75, or 0.9 to 1.5, or 1.0 to 1.35, or 1.0 to 1.25, or 1.0 to 1.15) times a thickness d2 of the pressure sidewall 173 of the second vane. Thus, in an example, the thickness d2 of the pressure sidewall 173 may be 0.25 inches and the thickness d1 may be in the range of 0.075 to 0.75 inches (or 0.1 to 0.625 inches, or 0.125 to 0.575 inches, or 0.175 to 0.475 inches, or 0.2 to 0.4375 inches, or 0.225 to 0.375 inches, or 0.25 to 0.3375 inches, or 0.25 to 0.3125 inches, or 0.25 to 0.2875 inches).

In another example, the thickness d1 of the radially-outer endwall may be configured to have a different range of thicknesses (including any of the above) in each of the first, second and third recesses 133, 135, 137. Also, the thickness d3 of the radially-outer endwall before the pocket 140 is formed may have different thicknesses in the areas corresponding to the first, second and third recesses. For example, the thickness of the radially-outer endwall 120 may be in the range of 0.5 to 0.7 inches (e.g., 0.6 inches) in the area corresponding to the first recess, 0.45 to 0.65 inches (e.g., 0.55 inches) in the area corresponding to the second recess, and 0.4 to 0.6 inches (e.g., 0.5 inches) in the area corresponding to the third recess.

In this example, the thickness d1 of the radially-outer endwall 120 in the first recess 133 may be in the range of 0.6 to 2.0 (or 0.8 to 1.75, or 0.8 to 1.5, or 0.9 to 1.35, or 1.0 to 1.25, or 1.0 to 1.15) times a thickness d2 of the pressure sidewall 173 of the second vane. Thus, in an example, the thickness d2 of the pressure sidewall 173 may be 0.25 inches and the thickness d1 may be in the range of 0.15 to 0.5 inches (or 0.2 to 0.4375 inches, or 0.2 to 0.375 inches, or 0.225 to 0.3375 inches, or 0.25 to 0.3125 inches, or 0.25 to 0.2875 inches).

The thickness d1 of the radially-outer endwall 120 in the second recess 135 may be in the range of 1.0 to 3.0 (or 1.0 to 2.5, or 1.0 to 1.8, or 1.2 to 1.6, or 1.25 to 1.5, or 1.25 to 1.4) times a thickness d2 of the pressure sidewall 173 of the second vane. Thus, in an example, the thickness d2 of the pressure sidewall 173 may be 0.25 inches and the thickness d1 may be in the range of 0.25 to 0.75 inches (or 0.25 to 0.625 inches, or 0.25 to 0.45 inches, or 0.3 to 0.4 inches, or 0.3125 to 0.375 inches, or 0.3125 to 0.35 inches).

The thickness d1 of the radially-outer endwall 120 in the third recess 137 may be in the range of 0.5 to 1.7 (or 0.75 to 1.6, or 0.8 to 1.5, or 0.9 to 1.35, or 1.0 to 1.25, or 1.0 to 1.15) times a thickness d2 of the pressure sidewall 173 of the second vane. Thus, in an example, the thickness d2 of the pressure sidewall 173 may be 0.25 inches and the thickness d1 may be in the range of 0.125 to 0.425 inches (or 0.1875 to 0.4 inches, or 0.2 to 0.375 inches, or 0.225 to 0.3375 inches, or 0.25 to 0.3125 inches, or 0.25 to 0.2875 inches).

In other examples, d2 may be 0.2, 0.25, 0.35, or 0.4 inches, and d1 may relate to d2 as described above.

It is also noted that the reduced thickness of the radially-outer endwall 120 in the pocket 130 facilitates heat removal from the nozzle segment. In other words, there is less material to cool but the surface area remains the same; therefore, less work is required to cool the nozzle segment. This helps reduce the thermal load and increases longevity of the part.

While the invention has been described in connection with what is presently considered to be the most practical and preferred examples, it is to be understood that the invention is not to be limited to the disclosed examples, but on the contrary, is intended to cover various modifications and equivalent arrangements included within the spirit and scope of the appended claims.

What is claimed is:

1. A nozzle segment for a gas turbine, comprising:

a radially-inner endwall, the radially-inner endwall having a flowpath face exposed to combustion gases of the gas turbine and a back face opposed to the flowpath face;

a radially-outer endwall, the radially-outer endwall having a flowpath face exposed to the combustion gases and a back face opposed to the flowpath face of the radially-outer endwall;

a first airfoil-shaped vane extending between the radially-inner endwall and the radially-outer endwall, the first vane having a leading edge facing in an upstream direction, a trailing edge facing in a downstream direction and opposing pressure and suction sidewalls extending in span between the radially-inner endwall and the radially-outer endwall and in chord between the leading edge and the trailing edge; and a second airfoil-shaped vane extending between the radially-inner endwall and the radially-outer endwall, the second vane having a leading edge facing in the upstream direction, a trailing edge facing in the downstream direction and opposing pressure and suction sidewalls extending in span between the radially-inner endwall and the radially-outer endwall and in chord between the leading edge and the trailing edge, wherein the second vane has a reinforcing rib extending between the pressure sidewall and the suction sidewall, wherein the radially-inner endwall is a single endwall having a continuous wall structure that extends circumferentially across the first airfoil-shaped vane and the second airfoil-shaped vane, wherein the radially-outer endwall is a single endwall having a continuous wall structure that extends circumferentially across the first airfoil-shaped vane and the second airfoil-shaped vane, wherein the back face of the radially-inner endwall and/or the back face of the radially-outer endwall has a pocket formed therein in an area between the pressure sidewall of the first vane and the suction sidewall of the second vane to enhance stiffness distribution between the second vane and the radially-inner endwall and/or radially-outer endwall, the entirety of each pocket being disposed in the continuous wall structure of the radially-inner endwall and/or the radially-outer endwall, wherein each said pocket comprises a plurality of recesses including first and second recesses, the second recess extending directly adjacent the reinforcing rib, and wherein a thickness of the radially-inner endwall and/or a thickness of the radially-outer endwall in the respective second recess is greater than a thickness of the radially-inner endwall and/or the thickness of the radially-outer endwall in the respective first recess.

2. The nozzle segment of claim 1, wherein each said plurality of recesses further comprising a third recess, wherein the second recess is downstream of the first recess and upstream of the third recess.

3. The nozzle segment of claim 2, wherein the thickness of the radially-inner endwall and/or the thickness of the radially-outer endwall in the respective second recess is greater than a thickness of the radially-inner endwall and/or a thickness of the radially-outer endwall in the respective third recess.

4. The nozzle segment of claim 3, wherein the back face of the radially-outer endwall has the pocket, and wherein each said pocket further comprises a first transition and a second transition formed in the back face of the radially-outer endwall to transition respectively between 1) the first recess and the second recess and 2) the second recess and the third recess.

5. The nozzle segment of claim 1, wherein each said pocket is formed directly adjacent the pressure sidewall of the second vane.

6. The nozzle segment of claim 1, further comprising an anti-rotation lug protruding radially outward from the back face of the radially-outer endwall in the area between the pressure sidewall of the first vane and the suction sidewall of the second vane and adjacent the second recess.

7. The nozzle segment of claim 6, wherein the anti-rotation lug comprises a first portion relatively proximal the pressure sidewall of the first vane and a second portion relatively proximal the suction sidewall of the second vane, wherein the second portion of the anti-rotation lug has an angled surface directly facing the suction sidewall of the second vane thereby causing the second portion of the anti-rotation lug to extend in a tapered manner in plan view.

8. The nozzle segment of claim 1, wherein the second vane includes a root coupled to the radially-inner endwall and a tip coupled to the radially-outer endwall.

9. The nozzle segment of claim 1, wherein the back face of the radially-outer endwall has the pocket, said nozzle segment further comprising a fillet between a bottom surface of the pocket and the back face of the radially-outer endwall.

10. The nozzle segment of claim 1, wherein the back face of the radially-outer endwall has the pocket, wherein the thickness of the radially-outer endwall in the second recess is in the range of 1.0 to 3.0 times a thickness of the suction sidewall of the second vane, and the thickness of the radially-outer endwall in the first recess is in the range of 0.6 to 2.0 times a thickness of the suction sidewall of the second vane.

11. The nozzle segment of claim 10, wherein the thickness of the radially-outer endwall in the second recess is in the range of 1.0 to 2.5 times a thickness of the suction sidewall of the second vane, and the thickness of the radially-outer endwall in the first recess is in the range of 0.8 to 1.75 times a thickness of the suction sidewall of the second vane.

12. The nozzle segment of claim 11, wherein the thickness of the radially-outer endwall in the second recess is in the range of 1.25 to 1.5 times a thickness of the suction sidewall of the second vane, and the thickness of the radially-outer endwall in the first recess is in the range of 0.9 to 1.35 times a thickness of the suction sidewall of the second vane.

13. A method of enhancing stiffness distribution in a nozzle segment of a gas turbine, the method comprising:

providing a nozzle segment comprising:

a radially-inner endwall, the radially-inner endwall having a flowpath face exposed to combustion gases of the gas turbine and a back face opposed to the flowpath face;

a radially-outer endwall, the radially-outer endwall having a flowpath face exposed to the combustion gases and a back face opposed to the flowpath face of the radially-outer endwall;

a first airfoil-shaped vane extending between the radially-inner endwall and the radially-outer endwall, the first vane having a leading edge facing in an upstream direction, a trailing edge facing in a downstream direction and opposing pressure and suction sidewalls extending in span between the radially-inner endwall and the radially-outer endwall and in chord between the leading edge and the trailing edge; and a second airfoil-shaped vane extending between the radially-inner endwall and the radially-outer endwall, the second vane having a leading edge facing in the upstream direction, a trailing edge facing in the downstream direction and opposing pressure and suction sidewalls extending in span between the radially-inner endwall and the radially-outer endwall and in chord between the leading edge and the trailing edge, wherein the second vane has a reinforcing rib extending between the pressure sidewall and the suction sidewall, wherein the radially-inner endwall is a single endwall having a continuous wall structure that extends circumferentially across the first airfoil-shaped vane and the second airfoil-shaped vane, wherein the radially-outer endwall is a single endwall having a continuous wall structure that extends circumferentially across the first airfoil-shaped vane and the second airfoil-shaped vane, and forming a pocket in the back face of the radially-inner endwall and/or the back face of the radially-outer endwall in an area between the pressure sidewall of the first vane and the suction sidewall of the second vane to enhance stiffness distribution between the second vane and the radially-inner endwall and/or radially-outer endwall, the entirety of each pocket being disposed in the continuous wall structure of the radially-inner endwall and/or the radially-outer endwall, wherein each said pocket comprises a plurality of recesses including first and second recesses, the second recess extending directly adjacent the reinforcing rib, and wherein a thickness of the radially-inner endwall and/or a thickness of the radially-outer endwall in the respective second recess is greater than a thickness of the radially-inner endwall and/or the thickness of the radially-outer endwall in the respective first recess.

14. The method of claim 13, wherein the step of forming a pocket comprises removing material from the radially-inner endwall and/or the radially-outer endwall.

15. The method of claim 13, wherein each said plurality of recesses further comprises a third recess, wherein the second recess is downstream of the first recess and upstream of the third recess.

16. The method of claim 15, wherein the thickness of the radially-inner endwall and/or the thickness of the radially-outer endwall in the respective second recess is greater than a thickness of the radially-inner endwall and/or a thickness of the radially-outer endwall in the respective third recess.

17. The method of claim 16, wherein the back face of the radially-outer endwall has the pocket, wherein each said pocket further comprises a first transition and a second transition formed in the back face of the radially-outer endwall to transition respectively between 1) the first recess and the second recess and 2) the second recess and the third recess.

18. The method of claim 13, further comprising providing an anti-rotation lug protruding radially outward from the back face of the radially-outer endwall in the area between the pressure sidewall of the first vane and the suction sidewall of the second vane and adjacent the second recess.

19. The method of claim 18, wherein the anti-rotation lug comprises a first portion relatively proximal the pressure sidewall of the first vane and a second portion relatively proximal the suction sidewall of the second vane, further comprising removing material from the second portion of the anti-rotation lug to form an angled surface directly facing the suction sidewall of the second vane thereby causing the second portion of the anti-rotation lug to extend in a tapered manner in plan view.

20. The method of claim 13, wherein the back face of the radially-outer endwall has the pocket, and wherein the thickness of the radially-outer endwall in the second recess is in the range of 1.0 to 3.0 times a thickness of the suction sidewall of the second vane, and the thickness of the radially-outer endwall in the first recess is in the range of 0.6 to 2.0 times a thickness of the suction sidewall of the second vane.

* * * * *